US006910528B2

(12) United States Patent
Abiko et al.

(10) Patent No.: US 6,910,528 B2
(45) Date of Patent: Jun. 28, 2005

(54) PLATE FIN HEAT EXCHANGER FOR A HIGH TEMPERATURE

(75) Inventors: Tetsuo Abiko, Nara (JP); Jyunichi Tujii, Toyonaka (JP); Takashi Eta, Machida (JP)

(73) Assignee: Sumitomo Precision Products Co., Ltd. (JP)

( * ) Notice: Subject to any disclaimer, the term of this patent is extended or adjusted under 35 U.S.C. 154(b) by 0 days.

(21) Appl. No.: 10/747,418

(22) Filed: Dec. 29, 2003

(65) Prior Publication Data

US 2004/0149425 A1 Aug. 5, 2004

Related U.S. Application Data

(62) Division of application No. 10/168,939, filed as application No. PCT/JP00/09209 on Dec. 25, 2000, now Pat. No. 6,840,313.

(30) Foreign Application Priority Data

| | | |
|---|---|---|
| Dec. 27, 1999 | (JP) | 11-370900 |
| Jun. 5, 2000 | (JP) | 2000-167321 |
| Aug. 10, 2000 | (JP) | 2000-242147 |
| Sep. 18, 2000 | (JP) | 2000-282103 |

(51) Int. Cl.[7] ..... F28F 3/00

(52) U.S. Cl. ..... 165/166; 165/167

(58) Field of Search ..... 165/166, 167, 165/146, 170

(56) References Cited

U.S. PATENT DOCUMENTS

| | | | | | |
|---|---|---|---|---|---|
| 2,462,421 | A | * | 2/1949 | Pitt | 165/81 |
| 2,782,009 | A | * | 2/1957 | Rippingille | 165/166 |
| 3,590,917 | A | * | 7/1971 | Huber et al. | 165/166 |
| 3,825,061 | A | * | 7/1974 | Bathla | 165/70 |
| 3,907,032 | A | * | 9/1975 | DeGroote et al. | 165/166 |

FOREIGN PATENT DOCUMENTS

| | | | | |
|---|---|---|---|---|
| FR | 2704310 | * | 10/1994 | 165/166 |
| JP | 57-134698 | * | 8/1982 | 165/166 |
| JP | 3-75497 | * | 8/1989 | 165/166 |
| JP | 2-217789 | * | 8/1990 | 165/166 |

* cited by examiner

*Primary Examiner*—Terrell Mckinnon
(74) *Attorney, Agent, or Firm*—Gerald E. Hespos; Anthony J. Casella

(57) ABSTRACT

A plate fin type heat exchanger is provided for achieving an increased heat exchanging efficiency and increased durability under violent variation in heat load. Fins for forming a channel for high-temperature fluid are secured to one of a pair of tube plates that form a channel for low-temperature fluid.

10 Claims, 9 Drawing Sheets

PLATE FIN HEAT EXCHANGER FOR A HIGH TEMPERATURE

This application is a division of application Ser. No. 10/168,939 filed Oct. 3, 2002.

TECHNICAL FIELD

The present invention relates to the improvement of a plate fin heat exchanger for a high temperature, for example, conducting heat exchange between combustion exhaust gases and the air. More specifically, the present invention relates to a plate fin heat exchanger for a high temperature with a structure in which elements obtained by soldering fins to both tube plate surfaces of the channel for low-temperature air are stacked and arranged via spacer bars and in which a tubular duct for high-temperature fluid can be used by itself as a heat exchanger container, this heat exchanger demonstrating excellent endurance and high heat exchange efficiency when used under severe conditions, for example, as a regenerator of a micro gas turbine power generator.

BACKGROUND ART

Micro gas turbine power generators have recently attracted attention and found practical use as emergency private power generators or medium-and small-scale distributed power sources. Gas turbines have a structure simpler than that of other internal combustion engines, can be produced on a mass scale, are easy to maintain and inspect, and operate at a low NOx level.

Micro gas turbine power generators of the next generation typically employ a structure of a single-shaft regeneration cycle gas turbine to improve the total power generation efficiency.

Thus, in such power generators, a compressor, a turbine, and a generator are arranged on one shaft, combustion gases from a combustion chamber rotate the turbine, and then heat exchange is conducted in a heat exchanger with the air that passed the compressor. The power generators of this type decrease, even if to a small degree, the loss of combustion gas energy and have a thermal conversion efficiency equal to, or better than that of conventional power generators employing diesel engines.

With the single-shaft regeneration cycle gas turbine, low-NOx exhaust gases are obtained with lean-mixture combustion, and using plate fin heat exchanger makes it possible to increase the heat exchange efficiency to about 90%.

On the other hand, micro gas turbine power generators are required to endure a large number of start/stop cycles and also to have the improved operation start-up characteristic immediately after they are turned on and to supply immediately the necessary power. This requirement is obvious for emergency situations, but is also valid for applications of such power generators as distributed power sources.

Therefore, plate fin heat exchangers used for heat exchange between combustion gases and compressed air are required to demonstrate an excellent heat exchange efficiency and to retain the attained heat exchange efficiency, while maintaining endurance sufficient to withstand vary intense heat input, in particular non-uniform temperature distribution inside the fluid channels and extreme variations of thermal load.

DISCLOSURE OF THE INVENTION

It is an object of the present invention to provide a plate fin heat exchanger capable of demonstrating the above-described performance required for plate fin heat exchangers for heat regeneration in micro gas power generators, that is, high endurance and heat exchange efficiency under extreme variations of thermal load, such a heat exchanger having a structure perfectly suitable for mass production.

It is another object of the present invention to provide a plate fin heat exchanger with a structure such that heat exchangers can be arranged in series so that waste heat recovery can be conducted separately at the downstream side of the regenerator.

The inventors have conducted a comprehensive study of structures making it possible to lessen thermal stresses in plate fin heat exchangers, for example, caused by non-uniform temperature distribution inside fluid channels and in the entire apparatus occurring when high-temperature combustion gas flows therein. The results obtained demonstrated that usually all of the fins located inside the high-temperature channels were soldered to low-temperature channels, but as shown in FIG. 1B, making all of the fins located inside the high-temperature channels independent for each low-temperature channels, rather than soldering them, lessened thermal stresses, greatly increased the endurance and also allowed for a transition to a modular structure, reduced the number of soldering operations, and increased mass productivity.

The inventors have also found that using non-directional distributors containing no corrugation fins and the like in the low-temperature channels in the above-described structure makes it possible to prevent one-side flow in the heat exchange unit, and that appropriately providing a shielding cover on the front surface of the low-temperature channel acing the inlet opening of high-temperature channel additionally increases endurance, without exposing the soldered portions of low-temperature channel to high-temperature fluid.

Thus, the first invention provides a plate fin heat exchanger for a high temperature, in which channels for low-temperature fluid and channels for high-temperature fluid are disposed in stacks and form a core independently for each channel for low-temperature fluid. For example, considering a structure in which the fins forming a channel for high-temperature fluid are fixed to at least one of a pair of tube plates forming the channels for low-temperature fluid as an element and forming a core by disposing a plurality of such elements inside a container such as a duct for high-temperature fluid makes it possible to provide plate fin heat exchangers with highly durable structure for high temperature, such heat exchangers being suitable for mass production.

The inventors have conducted a comprehensive study of structures that are easy to manufacture and have found that the assembling operation can be greatly facilitated if, as shown in FIG. 4, core assembly elements are produced by decreasing the size of fins located inside the high-temperature channels, fixing them to the low-temperature channel, and arranging small spacer bars in places where no fins are provided, and if those elements are assembled by stacking conducted, for example, by seal welding the spacer bars to each other.

Thus, the second invention relates to a plate fin heat exchanger for a high temperature with a structure in which channels for low-temperature fluid and channels for high-temperature fluid are disposed in stacks and form a core independently for each channel for low-temperature fluid by using core assembly elements in which spacer bars and fins forming the channels for high-temperature fluid are fixed to at least one of a pair of tube plates forming the channels for low-temperature fluid.

The inventors have also discovered that in a plate fin heat exchanger with the above-described structure in which a tubular duct for high-temperature fluid serves by itself as a heat exchanger container, if the duct for high-temperature fluid is extended and the respective separate plate fin heat exchangers or tube-type heat exchangers are disposed upstream and downstream of the high-temperature fluid, then a heat exchange system with a very good heat recovery efficiency can be constructed in which waste heat recovery can be conducted, for example, by using the upstream heat exchanger as a regenerator in a micro gas turbine power generator and using the downstream heat exchanger as a steam and/or hot water generator.

Thus, the third invention relates to a plate fin heat exchanger for a high temperature, in which a tubular duct for high-temperature fluid serves by itself as a heat exchanger container and channels for low-temperature fluid and channels for high-temperature fluid are disposed in stacks and form a core independently for each channel for low-temperature fluid by using core assembly elements in which fins forming the channels for high-temperature fluid, and optionally space bars, are fixed to at least one of a pair of tube plates forming the channels for low-temperature fluid, wherein at least one separate heat exchanger conducting heat exchange with high-temperature fluid is additionally disposed downstream of the heat exchangers located inside the duct.

Further, the inventors have assumed a double-wall tubular system structure in which heat exchangers are disposed in a ring-like fashion on the outer periphery of a turbine in a micro gas turbine power generator and are used as regenerators conducting heat exchange by causing the exhaust gases from the turbine to make a U turn and have conducted a comprehensive study of effective arrangement of the above-described core units.

The results obtained demonstrated that if a cylindrical duct for high-temperature fluid is used as a heat exchanger container and also as an outer tube, a plurality of the core units with the above-described structure are radially disposed between the inner tube of the turbine and the duct, and the inlet and outlet header tanks of low-temperature fluid are cantilever disposed on the cylindrical duct on the outer periphery or on the inner tube of the turbine, then a system with a very good heat recovery efficiency can be constructed which can demonstrate high durability and heat exchange efficiency under rapid changes of thermal load, for example, when the gas turbine is turned on or off. This finding led to the present invention.

Thus, the fourth invention relates to a plate fin heat exchanger for a high temperature, in which a plurality of core units are disposed radially inside a cylindrical body serving as a channel for high-temperature fluid or between a cylindrical body and an inner tube arranged inside the cylindrical body, those core units being formed by disposing channels for low-temperature fluid and channels for high-temperature fluid in stacks independently for each channel for low-temperature fluid by using core assembly elements in which fins forming the channels for high-temperature fluid, and optionally spacer bars, are fixed to at least one of a pair of tube plates forming the channels for low-temperature fluid, wherein (1) the inlet and outlet headers for low-temperature fluid are disposed on the side of the cylindrical body, and the core units are cantilever supported on the ducts, or (2) the inlet and outlet headers for low-temperature fluid are disposed on the side of the inner tube and the core units are cantilever supported on the inner tube.

BRIEF DESCRIPTION OF THE DRAWINGS

FIG. 2 is a disassembled view of the low-temperature fluid channel.

BEST MODE FOR CARRYING OUT THE INVENTION

STRUCTURE EXAMPLE 1

Figure 1A:
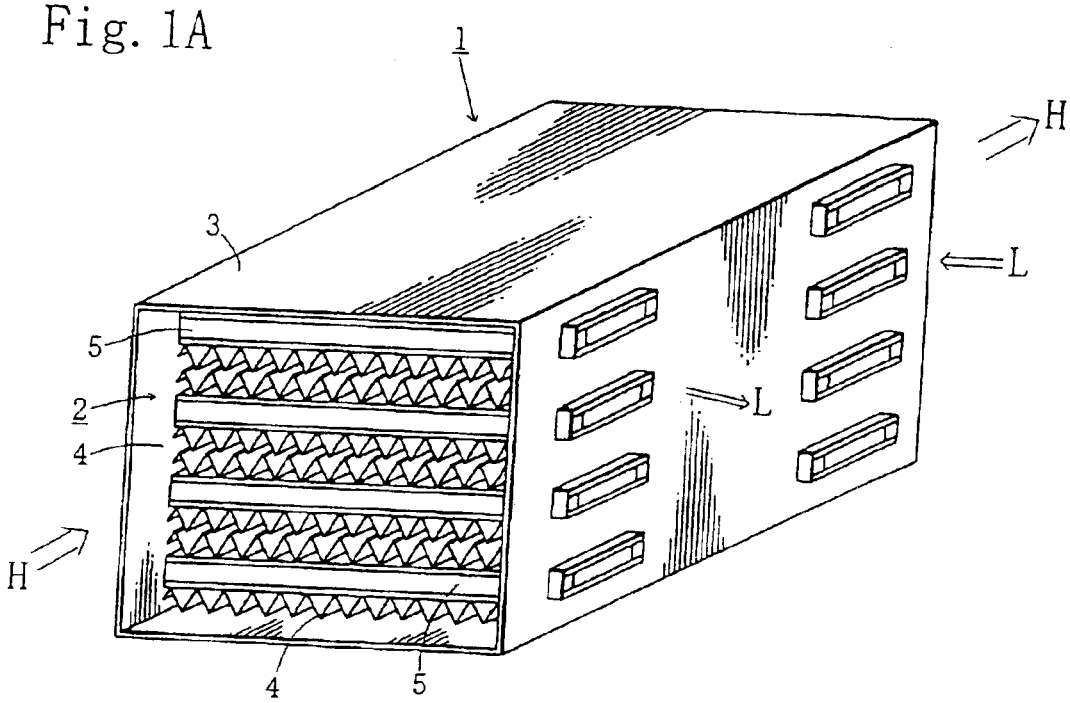
FIG. 1A is a perspective view illustrating an example of the plate fin heat exchanger for a high temperature in accordance with the present invention.

An example of the structure of the plate fin heat exchanger for a high temperature in accordance with the present invention will be explained below with reference to FIGS. 1 to 3. The example shown in FIG. 1A relates to counter-flow heat exchange between a high-temperature fluid and a low-temperature fluid. As shown in the figure, the high-temperature fluid H passes through a core 2 of a heat exchanger 1 from the front to the rear part thereof, whereas the low-temperature fluid L flows into the heat exchanger 1 through the side surface in the rear part thereof and flows out from the side surface in the front part thereof.

The core 2 of heat exchanger 1 has a structure in which high-temperature fluid channels 4 and low-temperature fluid channels 5 are stacked alternately inside a container 3.

Figure 1B:
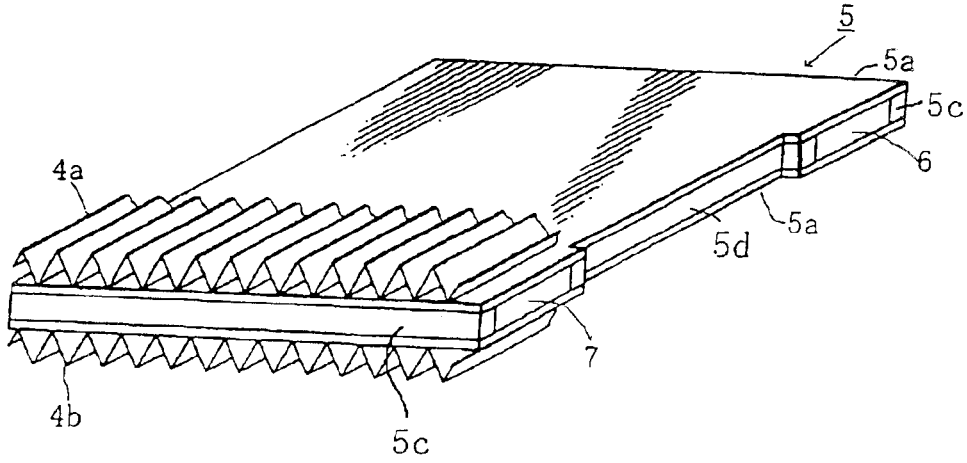
FIG. 1B is a perspective view illustrating the external appearance of a low-temperature fluid channel; only part of the fins is shown.
Figure 2A:
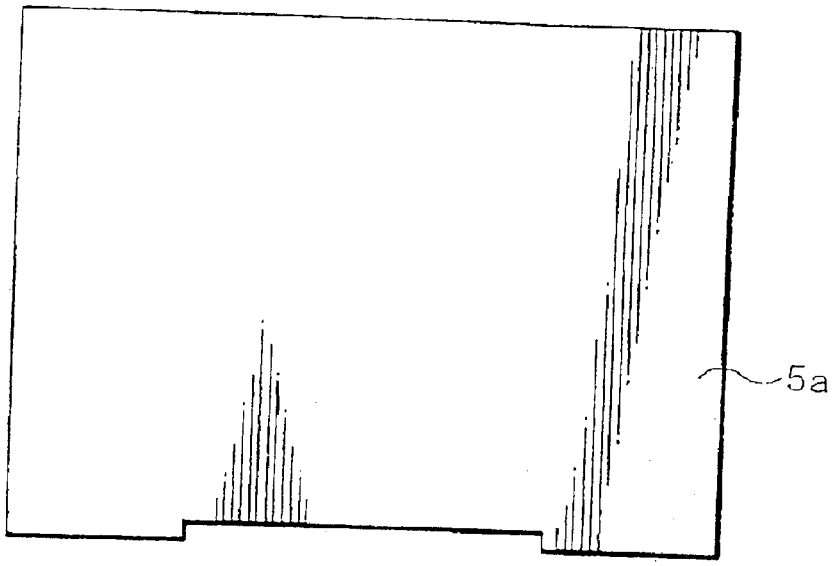
FIG. 2A shows a tube plate and FIG. 2B shows a channel body.
Figure 2B:
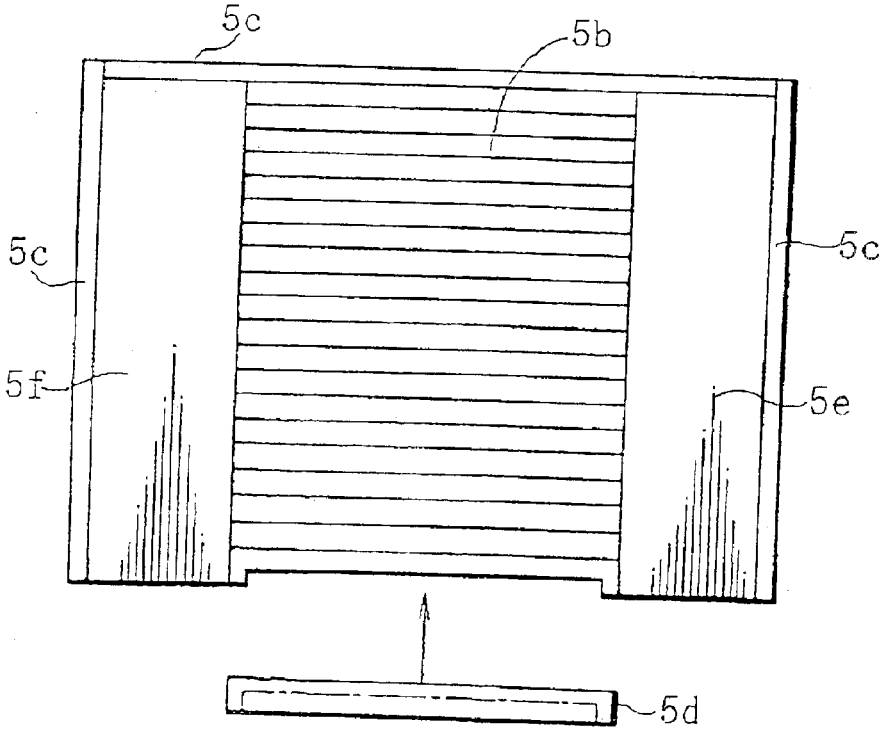

The low-temperature fluid channel 5, as shown in FIG. 1B and FIG. 2, has a configuration in which a corrugation fin 5*b* is sandwiched between two tube plates 5*a*, 5*a* and those components are brazed and integrated so that the peripheral portions are closed with spacer bars 5*c*. A spacer bar 5*d* on one end surface side is made short to form a fluid inlet opening 6 and a fluid outlet opening 7 and fluid distributor portions 5*e*, 5*f* serve as non-directional distributors having no fins disposed therein.

Furthermore, corrugation fins 4*a*, 4*b* are brazed to respective outer surfaces of the two tube plates 5*a*, 5*a* of low-temperature fluid channel 5. The above-described low-temperature fluid channels 5 are disposed with the prescribed spacing inside the container 3 containing the core 2 of heat exchanger 1. As a result, high-temperature fluid channels 4 are formed by the corrugation fins 4*a*, 4*b*.

Figure 3B:
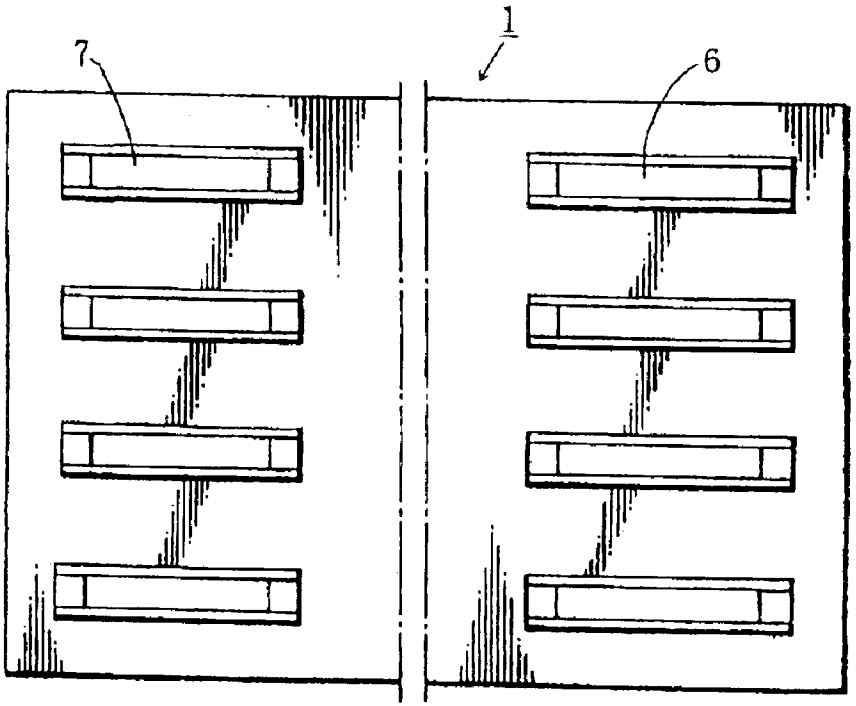
FIG. 3B illustrates the inlet and outlet openings of a low-temperature fluid channel.
Figure 3A:
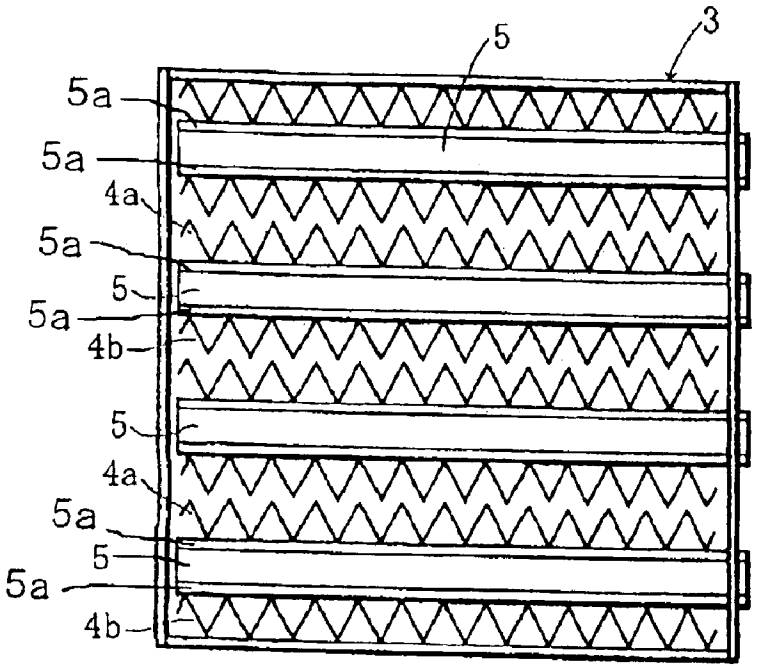
FIG. 3A is longitudinal section of the structure shown in FIG. 1A.

Thus, as shown in FIG. 3, the fluid inlet openings 6 and outlet openings 7 of low-temperature fluid channels 5 are cantilever supported on the side surface of the box-like container 3, and the low-temperature fluid channels 5 are disposed inside the container 3 at a spacing preventing the corrugation fins 4*a*, 4*b* from abutting each other.

For example, when the high-temperature fluid H rapidly flows into the plate fin heat exchanger for a high temperature in accordance with the present invention, which has the above-described structure, the side of container 3 where the inlet openings of high-temperature fluid channels 4 are located is intensely heated. The high-temperature fluid channels 4 are formed by corrugation fins 4*a*, 4*b* provided on the outer surface of low-temperature fluid channels 5. Those fins are not restricted inside the high-temperature fluid channels 4 and even when they are intensely heated, they do not accumulate thermal stresses and can effectively conduct the heat of high-temperature fluid H into the low-temperature fluid channels 5.

Furthermore, inside the low-temperature fluid channels 5, the low-temperature fluid L flowing in from a non-directional distributor portion 5*e* can participate in counter-flow heat exchange with the high-temperature fluid H, without a drift flow, and can flow out via the non-directional distributor portion 5*f* from the fluid outlet opening 7 after being heated to a high temperature. In this case, though the corrugation fins 4*a*, 4*b* of high-temperature fluid channels 4 are exposed to a high temperature, thermal stresses are not accumulated in the low-temperature fluid channel 5. Furthermore, intense heating of the low-temperature fluid channels 5 themselves also causes no accumulation of thermal stresses because of the cantilever support structure.

In the constitution of distributor portions 5*e*, 5*f* of low-temperature fluid channels 5, the rigidity of distributor portions 5*e*, 5*f* can be increased by using a structure in which the tube plates are provided with dimples and protruding portions of the dimples are abutted against and joined to each other inside the channels.

STRUCTURE EXAMPLE 2

Another example of the structure of the plate fin heat exchanger for a high temperature in accordance with the present invention will be explained below with reference to FIGS. 4 to 6. The example shown in FIG. 4 relates to counter-flow heat exchange between a high-temperature fluid and a low-temperature fluid. As shown in the figure, the high-temperature fluid H passes through a core 2 of heat exchanger 1 from the front to the rear part thereof, whereas the low-temperature fluid L flows into the heat exchanger 1 through the side surface in the rear part thereof and flows out from the side surface in the front part thereof.

The core 2 of heat exchanger 1 has a structure in which high-temperature fluid channels 4 and low-temperature fluid channels 5 are stacked alternately inside a container 3. The low-temperature fluid channel 5, as shown in FIG. 5 and FIG. 6, has a configuration in which a corrugation fin 5*b* is sandwiched between two tube plates 5*a*, 5*a* and those components are brazed and integrated so that the peripheral portions are closed with spacer bars 5*c*.

A spacer bar 5*d* on one end surface side is made short to form a fluid inlet opening 6 and a fluid outlet opening 7, and triangular fins are disposed in the fluid distributor portions 5*e*, 5*f* to form distribution channels.

Furthermore, corrugation fins 4*a*, 4*b* are brazed to respective outer surfaces of the two tube plates 5*a*, 5*a* of low-temperature fluid channel 5. The corrugation fins 4*a*, 4*b* are disposed in the positions facing the corrugation fins 5*g* which are the main fin components, except the distributor portions 5*e*, 5*f* located inside the low-temperature fluid channel 5, and short spacer bars 4*b* are fixed in four places mainly serving as the end portions of respective positions of distributor portions 5*e*, 5*f*.

By using elements for a core assembly based on the low-temperature fluid channels 5 of the above-described configuration, it is possible to stack and dispose the low-temperature fluid channels 5 inside the container 3 containing the core 2 of heat exchanger 1, with the prescribed spacing by using the spacer bars 4*b* abutted above and below thereof. The corrugation fins 4*a*, 4*b* provided opposite each other on the low-temperature fluid channels 5, 5 positioned above and below thereof form the high-temperature fluid channels 4. The spacer bars 4*b* on the right side surface, as shown in the figure, are seal welded to each other, and the spacer bars 4*b* on the left side, as shown in the figure, are not fixed.

Furthermore, the fluid inlet openings 6 and outlet openings 7 of low-temperature fluid channels 5 are cantilever supported, being secured only to the right side surface of the box-like container 3, as shown in the figure, and the spacer bar 4*b* side on the left side, as shown in the figure, is not fixed. Furthermore, low-temperature fluid channels 5 are disposed inside the container 3 at a spacing preventing the corrugation fins 4*a*, 4*b* from abutting each other. Header tanks (not shown in the figure) are fixedly disposed in the fluid inlet opening 6 and outlet opening 7 of container 3.

For example, when the high-temperature fluid H rapidly flows into the plate fin heat exchanger for a high temperature in accordance with the present invention, which has the above-described structure, the side of container 3 where the inlet openings of high-temperature fluid channels 4 are located is intensely heated. The high-temperature fluid channels 4 are formed by corrugation fins 4*a*, 4*b* provided in the central portion of the outer surface of low-temperature fluid channels 5. Those fins are not restricted inside the high-temperature fluid channels 4 and even when they are intensely heated, they do not accumulate thermal stresses and can effectively conduct the heat of high-temperature fluid H into the low-temperature fluid channels 5.

Furthermore, inside the low-temperature fluid channels 5, the low-temperature fluid L flowing in from a distributor portion 5*e* can participate in counter-flow heat exchange with the high-temperature fluid H, without a drift flow, and can flow out via the non-directional distributor portion 5*f* from the fluid outlet opening 7 after being heated to a high temperature. In this case, the corrugation fins 4*a*, 4*b* of high-temperature fluid channels 4 are not located in the positions corresponding to the distributor portions 5*e*, 5*f*, and even if they are exposed to a high temperature, thermal stresses are not accumulated in the low-temperature fluid channel 5. Furthermore, intense heating of the low-temperature fluid channels 5 themselves also causes no accumulation of thermal stresses because of the cantilever support structure.

Furthermore, the intense heat input observed when the high-temperature fluid H flows in at a high speed can be relieved by attaching shielding covers of various types to the front surface of the low-temperature fluid channel 5 facing the inlet opening of high-temperature fluid channel 4 in the above-described Structure Example 1 and Structure Example 2. Various means can be used for this purpose. For example, a louver member also serving as a flow adjusting component can be attached, or a thermal insulating member can be attached, or the tube plate of low-temperature fluid channel 5 can be extended and bent.

In accordance with the present invention, means for making the low-temperature fluid channels independent from each other can have a variety of structures other than the above-one structures. Thus, a structure in which corrugation fins are provided only on one surface of low-temperature fluid channels, a structure with cross-flow heat exchange, and a structure in which the duct of the high-temperature fluid serves by itself as the heat exchanger can be used.

In accordance with the present invention, in addition to the above-described alternate disposition of channels, a variety of other dispositions, for example, a combination of counter flow and cross flow, can be employed for stacking the low-temperature fluid channels and high-temperature fluid channels in the core, and the specific disposition can be appropriately selected according to the type of fluid or temperature.

In accordance with the present invention, no limitation is placed on the material of heat exchanger. However, if heat resistance is required, then well-known Fe-based, Ni-based, or Co-based heat-resistance alloys can be used. Moreover, austenitic heat-resistance steels, Co3Ti, Ni3Al, and stainless steels with an Al content of no more than 10 wt. % can be used. The same is true for the below-described structure examples.

STRUCTURE EXAMPLE 3

Figure 7:
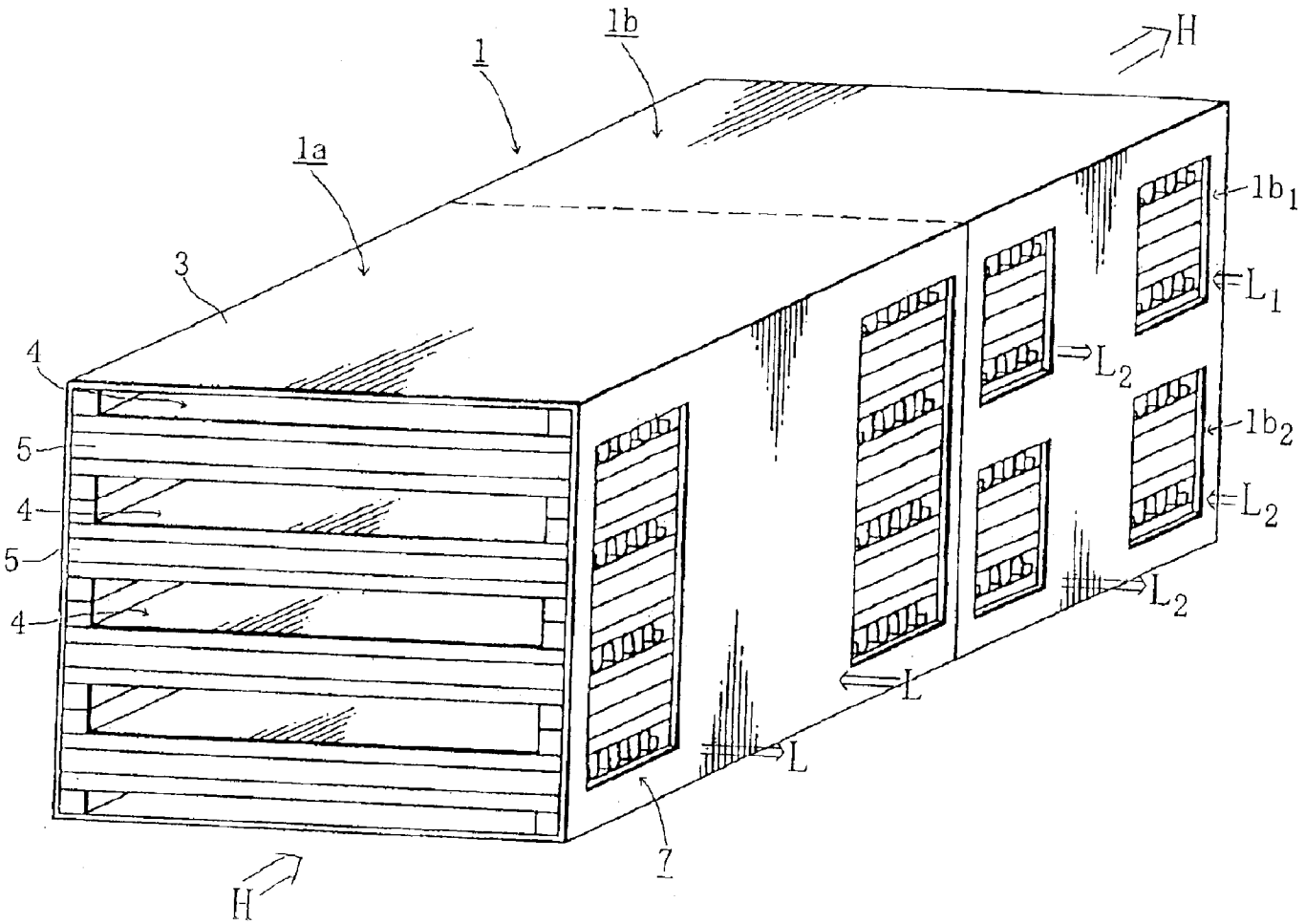
FIG. 7 is a perspective view illustrating a structure example of the plate fin heat exchanger for a high temperature in accordance with the present invention.

Another example of the structure of the plate fin heat exchanger for a high temperature in accordance with the present invention will be explained below with reference to FIGS. 7 and 8. This example relates to counter-flow heat exchange between a high-temperature fluid H and a low-temperature fluid. As shown in FIG. 1A, the high-temperature fluid H passes through a core 2 of heat exchanger 1, the side of heat exchanger 1 which is upstream of high-temperature fluid H is a pre-stage heat exchanger 1*a*, the downstream side is a post-stage heat exchanger 1*b*, and heat exchange is conducted in two stages.

Furthermore, the rear-stage heat exchanger 1*b* constitutes separate heat exchangers 1*b*1, 1*b*2 on the upper and lower side. In the figure, the length of post-stage heat exchanger 1*b* is represented to be equal to that of front-side heat exchanger 1*a*, but it can obviously be appropriately selected, for example, to be less or more depending of specifications of heat exchangers and required performance.

The pre-stage heat exchanger 1*a* positioned upstream of heat exchanger. 1 has a structure such that a low-temperature fluid L, which is composed of the air, flows in from the rear side surface of pre-stage heat exchanger 1*a* and flows out from the side surface in the front side thereof, with respect to a high-temperature fluid H, such as high-temperature exhaust gases, flowing from the front to the rear portion.

Figure 5:
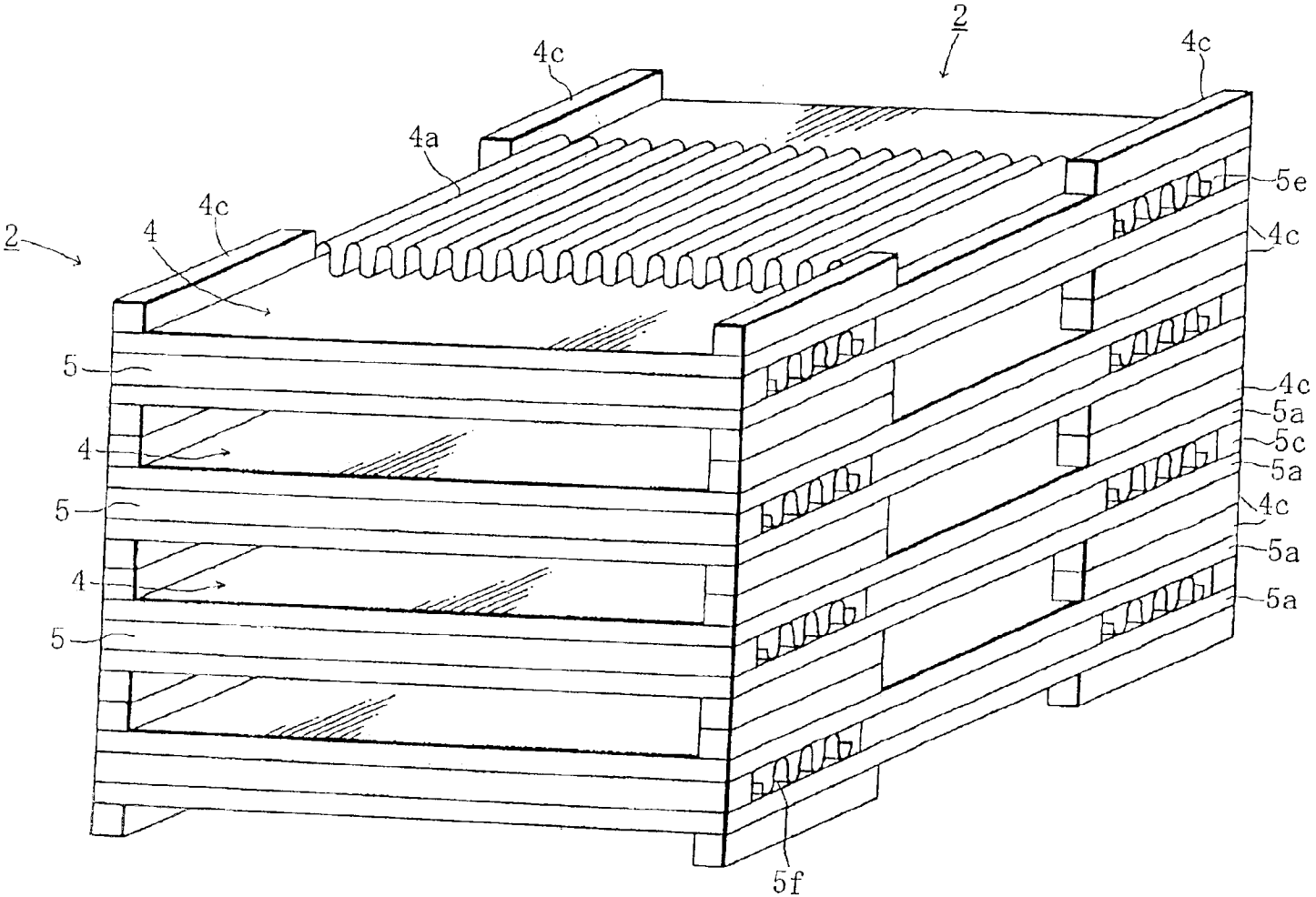
FIG. 5 is a perspective view illustrating an example of the plate fin heat exchanger for a high temperature in accordance with the present invention.

The core 2 of pre-stage heat exchanger 1*a* has a structure in which the high-temperature fluid channels 4 and low-temperature fluid channels 5 are stacked alternately inside the container 3, as shown in FIG. 5. The low-temperature fluid channel 5, as shown in FIG; 6, has a configuration such that a corrugation fin 5*g* is sandwiched between two tube plates 5*a*, 5*a*, and those components are brazed and integrated so that the peripheral portions are closed with spacer bars 5*c*.

A spacer bar 5*d* on one end surface side is made short to form a fluid inlet opening 6 and a fluid outlet opening 7 and triangular fins are disposed in the fluid distributor portions 5*e*, 5*f* to form distribution channels.

Furthermore, corrugation fins 4*a*, 4*b* are brazed to respective outer surfaces of the two tube plates 5*a*, 5*a* of low-temperature fluid channel 5. The corrugation fins 4*a*, 4*b* are disposed in the positions facing the main fin components 5*g*, except the distributor portions 5*e*, 5*f* located inside the low-temperature fluid channel 5, and short spacer bars 4*c* are fixed in four places mainly serving as the end portions of respective positions of distributor portions 5*e*, 5*f*.

By using elements for a core assembly based on the low-temperature fluid channels 5 of the above-described configuration, it is possible to stack and dispose the low-temperature fluid channels 5 inside the container 3 containing the core 2 of pre-stage heat exchanger 1*a*, with the prescribed spacing by using the spacer bars 4*c* abutted above and below thereof. The corrugation fins 4*a*, 4*a* provided opposite each other on the low-temperature fluid channels 5, 5 positioned above and below thereof form the high-temperature fluid channels 4. The spacer bars 4*c* on the right side surface, as shown in the figure, are seal welded to each other, and the spacer bars 4*c* on the left side, as shown in the figure, are not fixed.

Furthermore, the fluid inlet openings 6 and outlet openings 7 of low-temperature fluid channels 5 are cantilever supported, being secured only to the right side surface of the box-like container 3, as shown in the figure, and the spacer bar 4 side on the left side, as shown in the figure, is not fixed. Furthermore, low-temperature fluid channels 5 are disposed inside the container 3 at a spacing preventing the corrugation fins 4*a*, 4*b* from abutting each other. Header tanks (not shown in the figure) are fixedly disposed in the fluid inlet opening 6 and outlet opening 7 of container 3.

For example, when the high-temperature fluid H rapidly flows into the plate fin heat exchanger 1*a* for high temperature in accordance with the present invention, which has the above-described structure, the side of container 3 where the inlet openings of high-temperature fluid channels 4 are located is intensely heated. The high-temperature fluid channels 4 are formed by corrugation fins 4*a*, 4*a* provided in the central portion of the outer surface of low-temperature fluid channels 5. Those fins are not restricted inside the high-temperature fluid channels 4 and even when they are intensely heated, they do not accumulate thermal stresses and can effectively conduct the heat of high-temperature fluid H to the low-temperature fluid channels 5.

Furthermore, inside the low-temperature fluid channels 5, the low-temperature fluid L flowing in from a distributor portion 5*e* can participate in counter-flow heat exchange with the high-temperature fluid H, without a drift flow, and can flow out via the non-directional distributor portion 5*f* from the fluid outlet opening 7 after being heated to a high temperature. In this case, the corrugation fins 4*a*, 4*a* of high-temperature fluid channels 4 are not located in the positions corresponding to the distributor portions 5*e*, 5*f*, and even if they are exposed to a high temperature, thermal stresses are not accumulated in the low-temperature fluid channel 5. Furthermore, intense heating of the low-temperature fluid channels 5 themselves also causes no accumulation of thermal stresses because of the cantilever support structure.

The rear-stage heat exchanger 1*b* basically has the same structure as the above-described pre-stage heat exchanger 1*a* and constitutes separate heat exchangers 1*b*1, 1*b*2 on the upper and lower side. Thus, the plate fin heat exchangers for a high temperature of the above-described structure shown in FIG. 2 have a common container 3, are connected in series in the direction of high-temperature fluid flow and form an upstream pre-stage heat exchanger 1*a* and a downstream rear-stage heat exchanger 1*b*. The inlet and outlet openings for fluid of the rear-stage heat exchanger can be further divided in the vertical direction, providing for inlet and outlet of separate fluids and forming separate heat exchangers 1*b*1, 1*b*2 on the upper and lower side.

For example, a large amount of water can be introduced as a low-temperature fluid L1 into the upper heat exchanger 1*b*1 of rear-stage heat exchanger 1*b* and a hot-water at the prescribed temperature can be taken out. Moreover, a small amount of water can be introduced as a low-temperature fluid L2 into the lower heat exchanger 1*b*2 and steam can be taken out.

Figure 8:
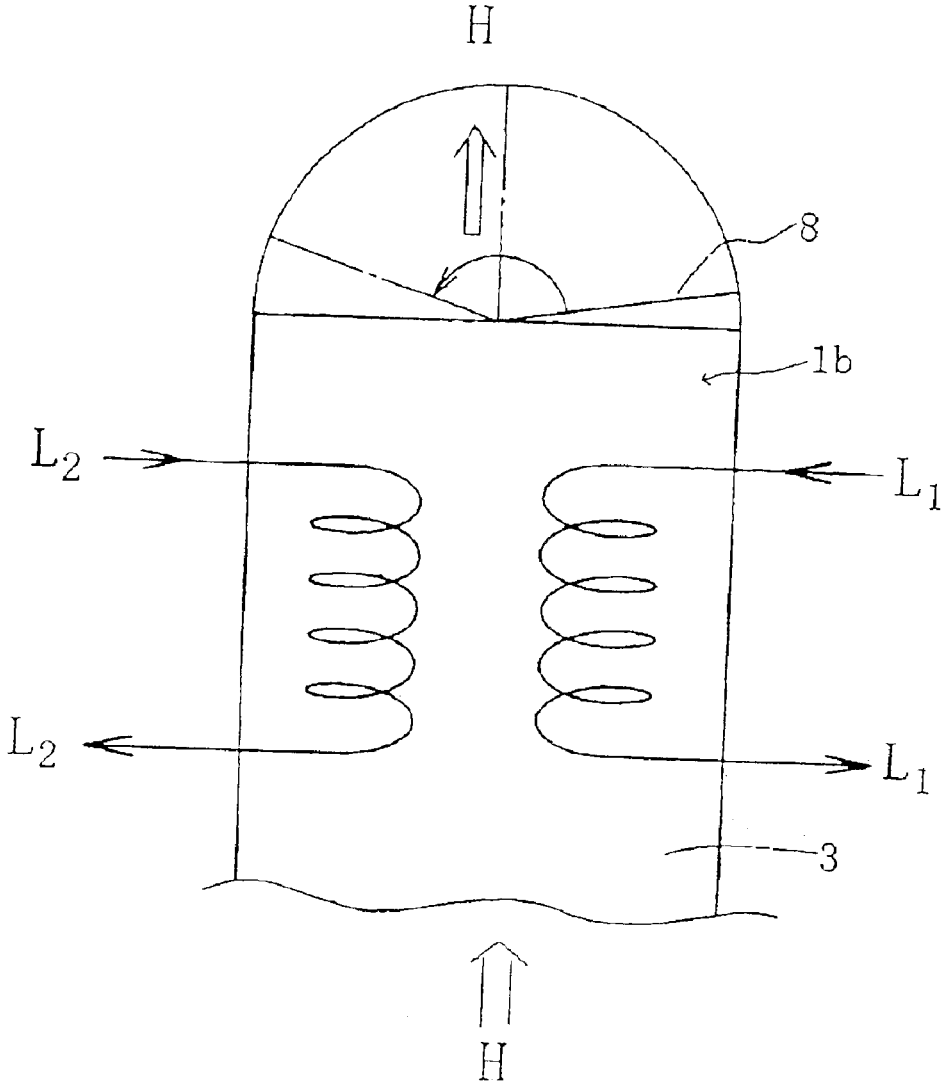
FIG. 8 illustrates another structure example of the rear-stage heat exchanger.

The rear-stage heat exchanger 1*b* is divided in two in the width direction of container 3, as shown in FIG. 8, by using a cantilever structure, shown in FIG. 1, forming separate heat exchangers, namely, a right heat exchanger and a left heat exchanger supported on respective side surfaces of container 3, and the respective different low-temperature fluid L1 and low-temperature fluid L2 can be introduced and taken out.

Furthermore, a structure can be also employed in which a switchable outlet damper 8 is provided on the downstream end of container 3, making it possible to select a heat exchanger through which a high-temperature fluid H is passed. With such a structure, in the above-described example, either hot water or steam can be selectively taken out.

With any of the above-described structures, even if the rear-stage heat exchanger 1*b* is exposed to a high temperature, thermal stresses are not accumulated in the low-temperature fluid channels 5, and intense heating of the low-temperature fluid channels 5 themselves also causes no accumulation of thermal stresses because of the cantilever support structure.

The rear-stage heat exchangers 1*b* can be arranged not only in one stage with the separation into upper and lower heat exchangers, but also in a multistage series. Therefore, a plurality of heat exchanges can be conducted till the temperature of high-temperature fluid drops to the prescribed temperature.

In the above-described example, a fin-plate heat exchanger with a cantilever structure identical to that of the pre-stage heat exchangers was used for the rear-stage heat exchanger 1*b*. However, heat exchangers of a variety of conventional structures, such as plate fin heat exchangers or tubular heat exchangers, can be selected and appropriately disposed in a common container according to the required performance or specifications.

STRUCTURE EXAMPLE 4

An example of the structure of the plate fin heat exchanger for a high temperature in accordance with the present invention will be explained below with reference to FIG. 9. This example relates to counter-flow heat exchange between a high-temperature fluid H flowing inside a large-diameter cylindrical body 10 and a low-temperature fluid L introduced into the heat exchanger 1.

Figure 9A:
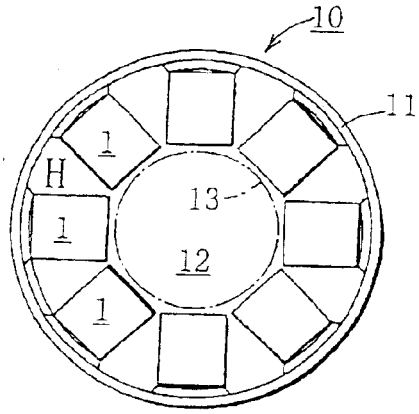
FIGS. 9A, 9C are plan views illustrating structure examples of the plate fin heat exchanger for a high temperature in accordance with the present invention.
Figure 9B:
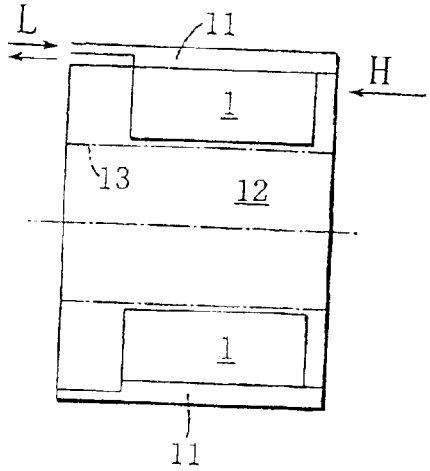
FIGS. 9B, 9D are longitudinal sectional views of main portions of the structures shown in FIGS. 9A, 9C, respectively.

As shown in FIGS. 9A, B, eight heat exchangers 1 are disposed radially along the inner peripheral surface of the large-diameter cylindrical body 10. Each heat exchanger 1 is cantilever supported on the large-diameter cylindrical body 10 and has a structure such that the header tank 11 of low-temperature fluid L is provided in the support zone.

The heat exchangers 1 disposed radially along the inner peripheral surface of the large-diameter cylindrical body 10 can be arranged so that the heat exchangers with a large length in the radial direction of large-diameter cylindrical body 10 will alternate with those with a small length, so that the heat exchangers will contact each other at the non-supported end surface thereof. In the present configuration, however, the heat exchangers of the same required length are selected and a hollow zone 12 is provided in the central portion of large-diameter cylindrical body 10.

Other devices or other fluid channels can be disposed in the hollow zone 12. For example, in a micro gas turbine power generator, an inner tube 13 is disposed and a gas turbine is arranged inside thereof. In such a structure example, the high-temperature fluid H is exhaust gases, and the low-temperature fluid L is the air.

Figure 9C:
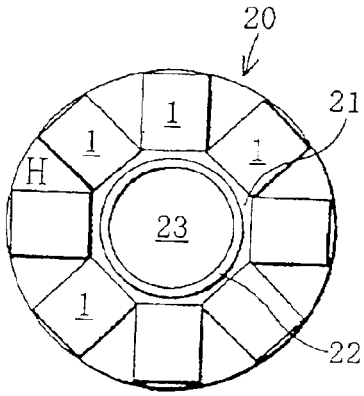
Figure 9D:
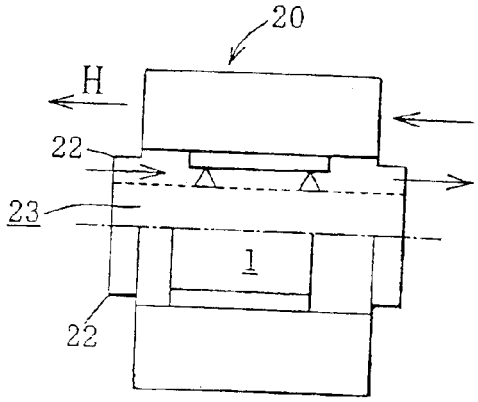

Furthermore, as shown in FIG. 9C, D, when eight heat exchangers 1 are disposed radially along the inner peripheral surface of the large-diameter cylindrical body 20, a structure can be employed in which an inner tube 21 is coaxially arranged inside the cylindrical body 20, a header tank 22 of low-temperature fluid L is disposed in the same zone, and the heat exchangers 1 are cantilever supported on the outer peripheral surface of inner tube 21. For example, in a micro gas turbine power generator, a gas turbine is disposed in the inner space 23 of inner tube 21, and exhaust gases flow as the high-temperature fluid H inside the duct between the cylindrical body 20 and inner tube 21.

The core 2 of heat exchanger 1, as shown in FIG. 5, has a structure in which the high-temperature fluid channels 4 and low-temperature fluid channels 5 are stacked alternately inside the container 3. The heat exchangers 1 arranged inside the cylindrical bodies 10, 20 are not limited to the above-described structure, and it is also possible to use a structure with a direct arrangement of cores 2.

Figure 6A:
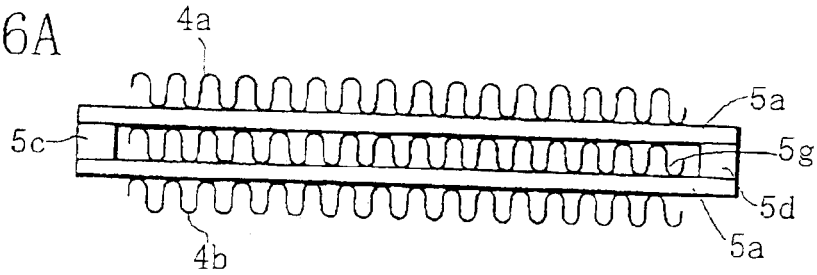
FIG. 6A is a central cross-sectional vie of the assembly unit using a low-temperature fluid channel as the base component.
Figure 6B:
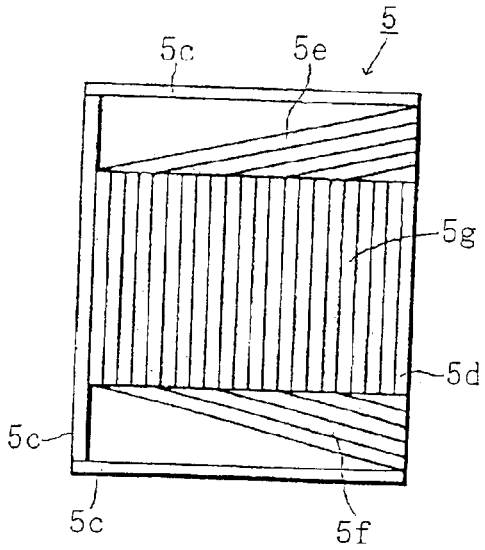
FIG. 6B is an inner view of the low-temperature fluid channel of the assembly unit.
Figure 6C:
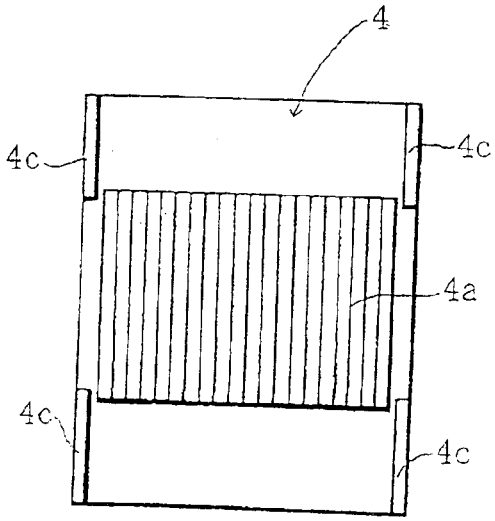
FIG. 6C is a top surface view of the assembly unit.

The low-temperature fluid channel 5 in core 2 was employed which had a structure of the above-described Structure Example 2 illustrated by FIG. 5 and FIG. 6.

For example, when the high-temperature fluid H rapidly flows into the heat exchangers 1 with a configuration of Structure Example 2, the side of container 3 where the inlet openings of high-temperature fluid channels 4 are located is intensely heated. The high-temperature fluid channels 4 are formed by corrugation fins 4*a*, 4*a* provided in the central portion of the outer surface of low-temperature fluid channels 5. Those fins are not restricted inside the high-temperature fluid channels 4 and even when they are intensely heated, they do not accumulate thermal stresses and can effectively conduct the heat of high-temperature fluid H into the low-temperature fluid channels 5.

Furthermore, inside the low-temperature fluid channels 5 with the configuration of Structure Example 2, the low-temperature fluid L flowing in from the distributor portion 5*e* can participate in counter-flow heat exchange with the high-temperature fluid H, without a drift flow, and can flow out via the distributor portion 5*f* from the fluid outlet opening 7 after being heated to a high temperature.

In this case, as described above, the corrugation fins 4*a*, 4*a* of high-temperature fluid channels 4 are not located in the positions corresponding to the distributor portions 5*e*, 5*f*, and even if they are exposed to a high temperature, thermal stresses are not accumulated in the low-temperature fluid channel 5. Furthermore, intense heating of the low-temperature fluid channels 5 themselves also causes no accumulation of thermal stresses because of the cantilever support structure.

EMBODIMENTS

Embodiment 1

A plate fin heat exchanger for a high temperature with the structure shown in FIGS. 1 to 3 was employed as a regenerator for a micro gas turbine power generator. Setting the dimensions and shape of the inlet openings of the container of such a heat exchanger so that they could be fit directly into the duct for combustion exhaust gases made the flanges unnecessary and allowed the pressure loss of the combustion exhaust gases to be minimized.

The temperature of combustion exhaust gases was set to two levels of 800° C. and 900° C. When heat exchange was conducted between the gases and a compressed intake air (0.4 MPa), a heat-exchange efficiency of 90% could be obtained in both cases. An austenitic stainless steel and a stainless steel containing 5 wt. % Al were used as the material for the heat exchanger at a temperature of exhaust gases of 800° C. and 900° C., respectively.

An accelerated test on endurance was conducted by starting an apparatus cooled to room temperature, cooling to the prescribed temperature once the prescribed time has elapsed, and restarting. No changes in the pressure loss of combustion exhaust gases, compressed intake pressure, and heat exchange efficiency were obtained, and neither peeling nor cracking appeared in heat exchanger parts.

Embodiment 2

Figure 4:
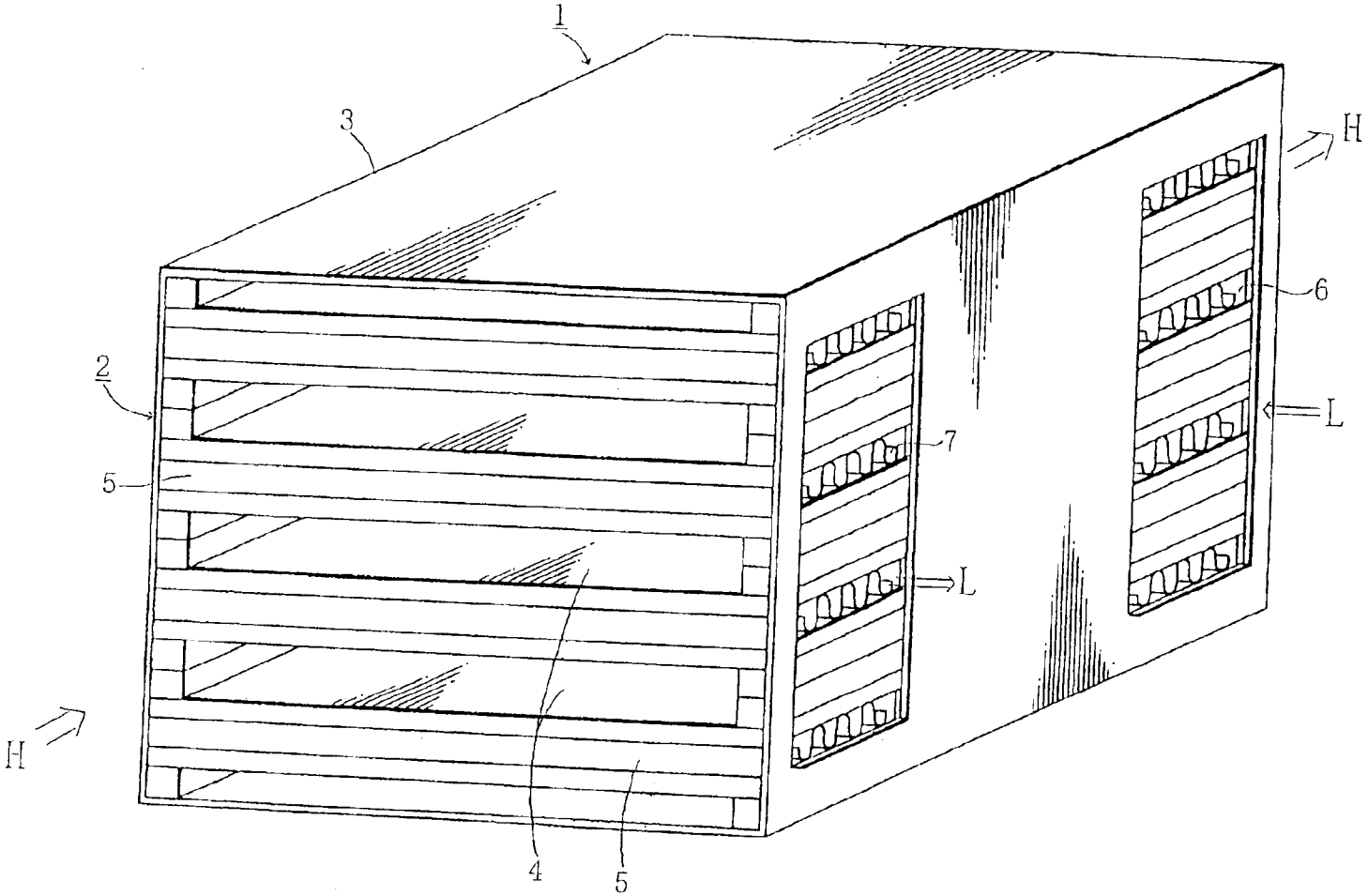
FIG. 4 is a perspective view illustrating an example of a core of the plate fin heat exchanger for a high temperature in accordance with the present invention.

A plate fin heat exchanger for a high temperature with the structure shown in FIGS. 4 to 6 was employed as a regenerator for a micro gas turbine power generator. Setting the dimensions and shape of the inlet openings of the container of such a heat exchanger so that they could be fit directly into the duct for combustion exhaust gases made the flanges unnecessary and allowed the pressure loss of the combustion exhaust gases to be minimized.

The temperature of combustion exhaust gases was set to two levels of 800° C. and 900° C. When heat exchange was conducted between the gases and a compressed intake air (0.4 MPa), a heat-exchange efficiency of 90% could be obtained in both cases. An austenitic stainless steel and a stainless steel containing 5 wt. % Al were used as the material for the heat exchanger at a temperature of exhaust gases of 800° C. and 900° C., respectively.

An accelerated test on endurance was conducted by starting an apparatus cooled to room temperature, cooling to the prescribed temperature once the prescribed time has elapsed, and restarting. No changes in the pressure loss of combustion exhaust gases, compressed intake pressure, and heat exchange efficiency were obtained, and neither peeling nor cracking appeared in heat exchanger parts.

Embodiment 3

A plate fin heat exchanger for a high temperature with the structure shown in FIGS. 4 to 6 was employed as a regenerator for a micro gas turbine power generator. Further, a plate fin heat exchanger for a high temperature, which had a structure shown in FIGS. 4 to 6, was employed as a boiler for conducting heat exchange with the exhaust gases that passed through the regenerator. A configuration was used in which the regenerator was disposed in the fore stage and boiler was disposed in the rear stage, as shown in FIG. 7.

In the rear-stage boiler, the inlet and outlet openings for fluid were split in the vertical direction, the header tanks were installed, and hot water or steam could be obtained by changing the amount of supplied water.

Setting the dimensions and shape of the inlet openings of the container of such a heat exchanger so that they could be fit directly into the duct for combustion exhaust gases made the flanges unnecessary and allowed the pressure loss of the combustion exhaust gases to be minimized.

The temperature of combustion exhaust gases was set to two levels of 800° C. and 900° C. When heat exchange was conducted between the gases and a compressed intake air (0.4 MPa), a heat-exchange efficiency of 90% could be obtained in both cases. Furthermore, heat was recovered in the rear-stage boiler and the temperature of combustion exhaust gases could be decreased close to a normal temperature.

An austenitic stainless steel and a stainless steel containing 5 wt. % Al were used as the material for the heat exchanger at a temperature of exhaust gases of 800° C. and 900° C., respectively.

An accelerated test on endurance was conducted by starting an apparatus cooled to room temperature, cooling to the prescribed temperature once the prescribed time has elapsed, and restarting. No changes in the pressure loss of combustion exhaust gases, compressed intake pressure, and heat exchange efficiency were obtained, and neither peeling nor cracking appeared in heat exchanger parts.

Embodiment 4

A plate fin heat exchanger for a high temperature with the structure shown in FIGS. 4 to 6 was employed in a layout shown in FIGS. 9C, D as a regenerator for a micro gas turbine power generator. Thus, a gas turbine was disposed in the space 23 inside the inner tube 21, the exhaust gases released therefrom were caused to make a U turn, and heat exchange with the air was conducted in fin-plate heat exchangers. 1 disposed radially between the cylindrical body 20 and inner tube 21.

Setting the dimensions and shape of the heat exchangers so that they could be cantilever disposed on the duct for combustion exhaust gases composed of ring-like spaces made the flanges unnecessary and allowed the pressure loss of the combustion exhaust gases to be minimized.

The temperature of combustion exhaust gases was set to two levels of 800° C. and 900° C. When heat exchange was conducted between the gases and a compressed intake air (0.4 MPa), a heat-exchange efficiency of 90% could be obtained in both cases.

An austenitic stainless steel and a stainless steel containing 5 wt. % Al were used as the material for the heat exchanger at a temperature of exhaust gases of 800° C. and 900° C., respectively.

An accelerated test on endurance was conducted by starting an apparatus cooled to room temperature, cooling to the prescribed temperature once the prescribed time has elapsed, and restarting. No changes in the pressure loss of combustion exhaust gases, compressed intake pressure, and heat exchange efficiency were obtained, and neither peeling nor cracking appeared in heat exchanger parts.

Industrial Applicability

The plate fin heat exchanger for a high temperature in accordance with the present invention has a structure in which employing independent configurations for low-temperature channels makes it possible to lessen thermal stresses caused by non-uniform temperature distribution inside fluid channels and in the entire apparatus occurring when high-temperature combustion gas flows therein, to obtain high endurance and heat exchange efficiency under extreme variations of thermal load that are required for plate fin heat exchangers for regeneration in micro gas turbine generators, and to make a transition to a modular structure, to reduce the number of soldering operations, and to obtain excellent mass productivity.

Furthermore, since the structure of the heat exchanger in accordance with the present invention is made independent for each low-temperature fluid channel, a multifluid heat exchanger can be implemented in which steam can be obtained by introducing water instated of compressed air as in the above-described structure examples. Moreover, in the above-described structure examples, independent configurations were employed for each low-temperature fluid channel and cantilever support was provided on the side surface of the container. Therefore, such a structure was beneficial in terms of maintenance because once a problem has risen associated with any of the low-temperature fluid channels, it could be easily closed or replaced.

In particular, the advantage of the structures of Embodiment 2 and Embodiment 3 is that the assembly units containing a low-temperature fluid channel as the main component have a base shape of a rectangular plate and can be assembled merely by stacking, without any molding. Furthermore, assembling can be conducted by joining by means of soldering or welding only in a very few necessary places.

In a structure in which heat exchangers are arranged in a ring-like fashion on the outer periphery of a turbine in a micro gas turbine power generator and serve as regenerators conducting heat exchange by causing a U turn of exhaust gases of the turbine, arranging radially a plurality of core units and also cantilever disposing the inlet and outlet header tanks of low-temperature fluid on the outer tubular duct or on the inner tube of the turbine makes it possible to construct a system with a very good heat recovery efficiency that can demonstrate high endurance and heat exchange efficiency under extreme variations of thermal load, for example, when the gas turbine is turned on and off.

What is claimed is:

1. A plate fin heat exchanger for a high temperature, comprising: a container having a support wall, a plurality of channel assemblies disposed in the container, each of said channel assemblies having two tube plates, low-temperature fluid channels being defined between the tube plates of each of said channel assemblies, a low-temperature inlet and a low-temperature outlet being formed between the tube plates on a first side of each of the channel assemblies and providing communication with the low-temperature fluid channels thereof, at least one array of high-temperature fins on an outwardly facing surface of at least one of the tube plates of each of said channel assemblies, the first side of each said channel assemblies being secured to the support wall of the container so that the low-temperature inlet and the low-temperature outlet communicate through the support wall of the container and so that the respective channel assemblies are cantilevered from the support wall, the high-temperature fins defining high-temperature fluid channels between adjacent cantilevered channel assemblies, whereby the cantilevered channel assemblies do not contact one another and contact the container only at the support wall for avoiding accumulation of thermal stresses.

2. The plate fin heat exchanger for a high temperature of claim 1, wherein a non-directional distributor is defined inside each of said channel assemblies for distributing low-temperature fluid non-directionally to the low-temperature fluid channels.

3. The plate fin heat exchanger for a high temperature claim 2, wherein dimples are provided on portions of the tube plates defining the distributors of the low-temperature channel assemblies and are abutted against and joined to each other inside the respective channel assembly.

4. The plate fin heat exchanger for a high temperature of claim 1, wherein a shielding cover is attached to a front surface of each of the channel assemblies facing the inlet openings of the high-temperature fluid channels.

5. The plate fin heat exchanger for a high temperature of claim 1, wherein the container is formed with a high-temperature inlet and a high-temperature outlet at opposite ends of the container and configured for communicating with the high temperature fluid channels.

6. The plate fin heat exchanger for a high temperature of claim 1, wherein each of said channel assemblies has arrays of high-temperature fins disposed on the outwardly facing surfaces of both said tube plates thereof, such that the high-temperature fluid channels have high-temperature fins on each of said adjacent channel assemblies.

7. The plate fin heat exchange for a high temperature of claim 1, further comprising spacers extending between the two tube plates of each of said channel assemblies at all peripheral locations on said channel assemblies spaced from the low-temperature inlet and the low-temperature outlet for substantially preventing fluid communication with the low-temperature fluid channels at locations spaced from the low-temperature inlet and the low temperature outlet.

8. The plate fin heat exchanger for a high temperature of claim 1, wherein the arrays of high-temperature fins define high-temperature corrugation fins.

9. The plate fin heat exchanger for a high temperature of claim 1, wherein each of said channel assemblies has corrugation fins disposed between the tube plates for defining the low-temperature fluid channels.

10. The plate fin heat exchanger for a high temperature of claim 1, wherein the high-temperature fluid channels include a high-temperature inlet and a high-temperature outlet aligned substantially normal to the low-temperature inlet and the low-temperature outlet.

* * * * *